United States Patent [19]

Reist

[11] 4,038,893

[45] Aug. 2, 1977

[54] APPARATUS FOR CUTTING CONTINUOUSLY ARRIVING FLAT STRUCTURES

[75] Inventor: Walter Reist, Hinwil, Switzerland

[73] Assignee: Ferag AG, Hinwil, Switzerland

[21] Appl. No.: 671,413

[22] Filed: Mar. 29, 1976

[30] Foreign Application Priority Data

Apr. 8, 1975 Switzerland ..... 4407/75

[51] Int. Cl.[2] ..... B26D 7/06

[52] U.S. Cl. ..... 83/154; 83/267; 83/337

[58] Field of Search ..... 83/155, 154, 206, 267, 83/282, 337

[56] References Cited

U.S. PATENT DOCUMENTS

| | | | |
|---|---|---|---|
| 3,018,679 | 1/1962 | Crowley et al. | 83/154 |
| 3,455,193 | 7/1969 | Jackson, Jr. et al. | 83/337 |

*Primary Examiner*—Willie G. Abercrombie
*Attorney, Agent, or Firm*—Werner W. Kleeman

[57] ABSTRACT

An apparatus for cutting continuously arriving flat structures, especially printed products, wherein there is provided a revolving driven rim of similar cutter tools which can be each actuated via entrainably moving follower elements through the agency of a common control cam. Operatively associated with each of the cutter tools are feed means for the infeed and removal of a flat structure.

26 Claims, 11 Drawing Figures

APPARATUS FOR CUTTING CONTINUOUSLY ARRIVING FLAT STRUCTURES

BACKGROUND AND SUMMARY OF THE INVENTION

The present invention relates to a new and improved construction of apparatus for cutting continuously incoming or arriving flat structures, especially printed products.

It is a primary object of the present invention to provide an apparatus of the aforementioned type which is extremely efficient and reliable in operation and capable of positively cutting continuously arriving flat structures, such as typically printed products of the most varied type.

Another object of this invention aims at a new and improved construction of cutting apparatus for flat structures, which apparatus is relatively simple in construction and design, extremely reliable in operation, and requires a minimum of servicing and maintenance.

Now in order to implement these and still further objects of the invention, which will become more readily apparent as the description proceeds, the apparatus of the present invention is manifested by the features that there is provided a revolving driven rim of similar cutter or cutting tools, each of which can be actuated by a common control cam through the agency of traveling follower elements. Operatively associated with each of the cutter tools is feed means for the infeed and outfeed or withdrawal of a flat structure.

BRIEF DESCRIPTION OF THE DRAWINGS

The invention will be better understood and objects other than those set forth above, will become apparent when consideration is given to the following detailed description thereof. Such description makes reference to the annexed drawings illustrating two exemplary embodiments of the invention and wherein.

DETAILELD DESCRIPTION OF THE INVENTION

Figure 1:
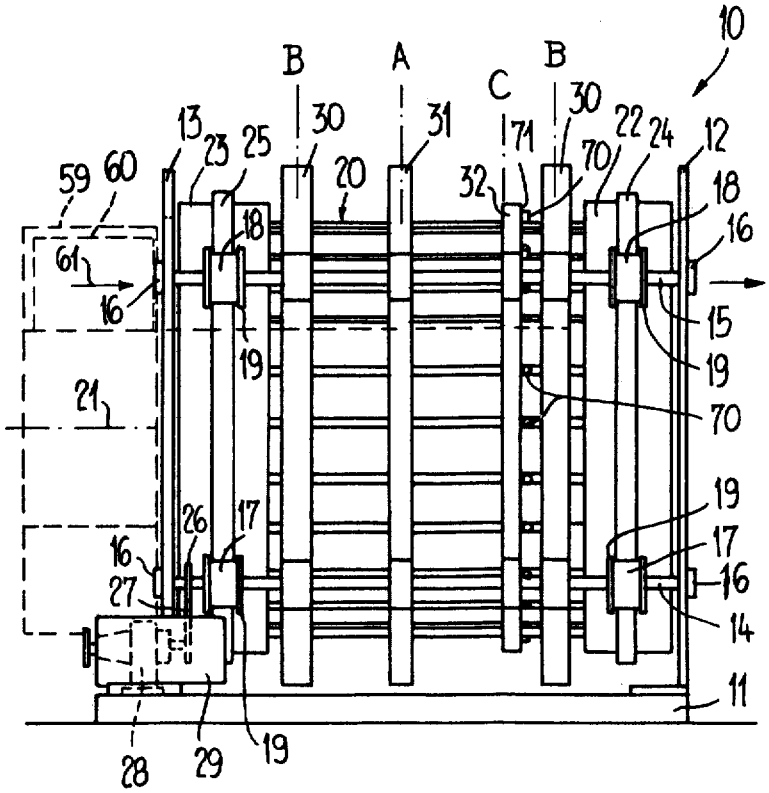
FIG. 1 is a schematic side view of the one or the other embodiment.

Describing now the drawings, the apparatus 10 illustrated in FIG. 1 is built-up upon a base or socket 11 upon which there are supported two carrier or support frames 12, 13 which, in turn, exhibit the configuration of a gantry. The openings in the support frames 12, 13 are not visible in FIG. 1 since such appear from the side. Between the support frames 12, 13 there extend a number of shafts, in this case four shafts, of which in FIG. 1 there is visible a lower shaft 14 and an upper shaft 15. The remaining shafts are at the same elevation, however in FIG. 1 at the opposite side of the observer, and therefore not visible. The ends of the shafts 14, 15 are rotatably mounted in bearings 16 which are secured to the support frames 12, 13. Seated upon both the shafts 14, 15 as well as also upon the nonvisible shafts are a respective pair of rolls or rollers. Thus, upon the shaft 14 there are mounted the rollers 17 and upon the shaft 15 the rollers 18. These rollers are provided at their end faces with rims or flanges 19.

Continuing, between the rollers there is supported a cell wheel 20 having an essentially horizontal lengthwise axis, the cell wheel appearing in FIG. 1 essentially in the form of a rectangle inasmuch as the same is viewed from the side. The cell wheel 20 is thus held by the rollers and is rotatably mounted about the axis of rotation indicated by the broken line 21. The compartments of the cell wheel 20 are open at both of these end faces, whereas the cell wheel itself is surrounded by holder rings 22, 23 at the region of its end faces. The holder rings 22, 23 each carry a collar 24, 25 which bears upon the contact surfaces of the rollers 17, 18 between the rims 19. Additionally, a sprocket gear 26 is seated upon the shaft 14 and is coupled via a sprocket chain 27 and a reduction gearing 28 with a drive motor 29. Consequently, by turning-on the motor 29 the cell wheel 20 can be placed into rotation via the rollers 17. These rollers 17 as well as the collars 24 and 25 can be provided for this purpose with not particularly illustrated teeth.

The shafts 14 and 15 as well as also the shafts not visible in FIG. 1 extend through rings 30, 31 and through a ring segment 32 and are rotatably mounted therein. The rings 30, 31 and the ring segment 32 surround with play the cell wheel 20 and the support, as will be explained more fully hereinafter, at their inner surface or inside a control cam and at its end face a friction rim, which serve to actuate the elements provided in the compartments of the cell wheel. It is to be observed that the rings 30, 31 and the ring segment 32 are secured against being rotatably entrained by the cell wheel 20 by virtue of the fact that two or more of the shafts 14, 15 piercingly extend through such rings 30, 31 and the ring segment 32.

Reference is now made to FIGS. 2 to 5. The cell wheel 20 embodies a hollow hub 33, at the outer surface of which there are secured at uniform angular spacing radially protruding and identically constructed partition walls 34. Hence, between two neighboring partition walls 34 there is always formed a compartment 35 of the cell wheel 20. With the exemplary embodiments under discussion there are provided, by way of example, a total of 24 compartments 35. Each of the compartments 35 serves to receive a flat structure which is to be cut during the course of a revolution of the cell wheel 20. For this purpose each of the compartments 35 is also equipped with a cutting or cutter tool consisting of at least one pair of cutters or knives and at least one pair of press or contact jaws, and further with a feed drive which delivers the flat structure to be cut to the cutter tool and away therefrom. The embodiment of FIGS. 2 and 5A (as well as FIGS. 6 to 9) differ from that of FIGS. 3, 5B and 10 only insofar as the former carries out cuts extending at right-angles to the axis of rotation 21 of the cell wheel 20 and the latter carries out cuts which extend parallel to the axis of rotaton 21 of the cell wheel 20. Hence, functionally corresponding components have been identified throughout with the same reference characters, yet it is to be appreciated that the reference characters of the first embodiment do not have associated therewith any prime marking, those of the last embodiment however have associated with their reference characters a prime marking.

In the description to follow there will be described the cutter tools and the feed drive in that sequence.

Figure 2:
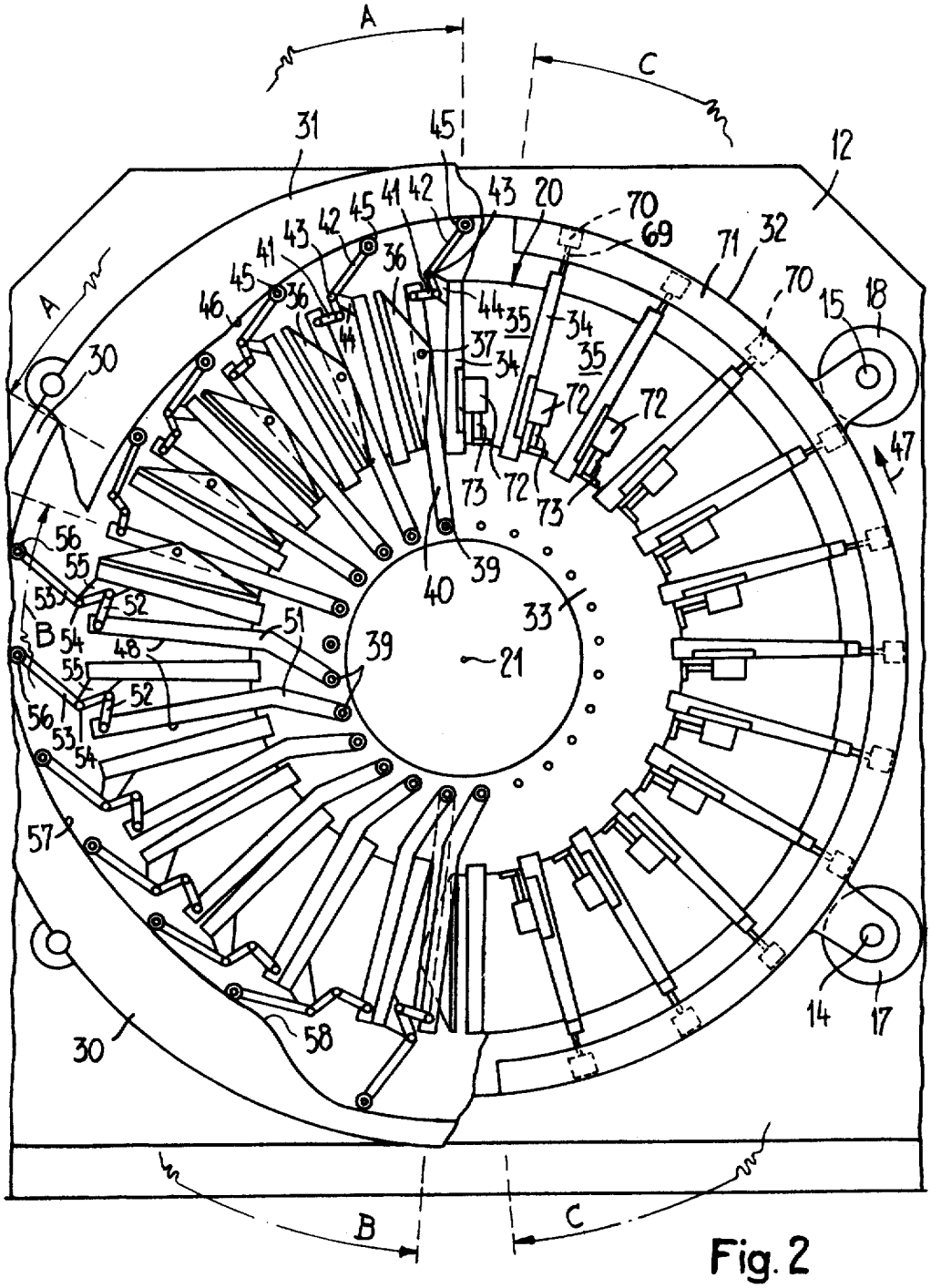
FIG. 2 is a simplified cross-sectional view through the one exemplary embodiment, wherein the sectors designated by reference characters A, B and C in this Figure constitute sections in the planes designated by the same reference characters in FIG. 1.
Figure 7:
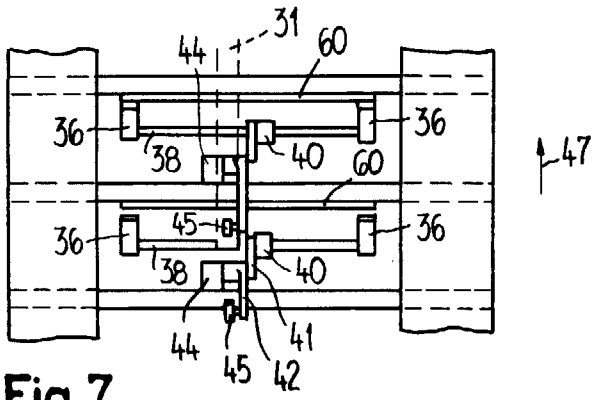

From the showing of FIG. 2 (sector A) and FIG. 7, it will be seen that in each compartment 35 there is arranged a pair of press or contact jaws 36 which are hingedly secured at location 37 at a traverse or crosstie member 38 (FIG. 7). The traverse 38 is secured at a rocker or balance 40 which is hingedly connected at location 39 at the hub 33. The counterjaw of the contact jaws 36 is formed by the surface of the neighboring partition wall 34 which confronts such contact jaws The free end of each balance or rocker 40 is hingedly coupled through the agency of a hinge coupling 41 at an angle lever 42 the apex of which is pivotably mounted at location 43 at a bearing eyelet 44 which is attached to the side of the neighboring partition wall 34 facing away from the contact jaws 36. At its other free end the angle lever 42 carries a follower roll or roller 45 which is held, by not particularly illustrated conventional spring means, in continuous engagement with a radially inwardly oriented control cam 46 which is formed at the inner surface or inside of the ring 31. The control cam 46 is configured in such a manner that the contact jaws 36, during the course of one revolution or rotation of the cell wheel 20, carry out a closing stroke as well as an opening stroke. Under the assumption that the cell wheel is rotating in the direction indicated by the arrow 47 in FIG. 2, the contact jaws 36, upon passage through the sector designated by reference character A in FIG. 2, carry out a closing stroke.

Figure 8:
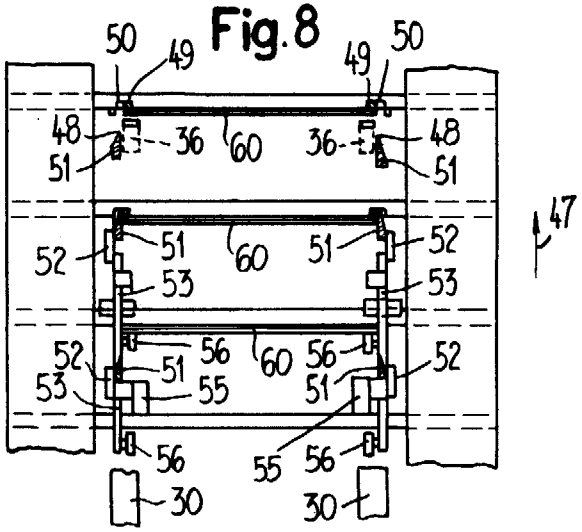
FIGS. 6, 7, 8 and 9 are markedly simplified illustrations showing views looking radially into the compartments of the apparatus of FIG. 2 during different operational positions, wherein in each instance there have only been schematically shown those components which are effective at that moment in time.
Figure 9:
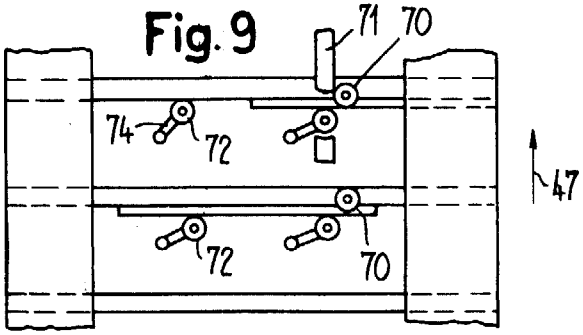

From the showing of FIG. 2 (sector B) as well as FIG. 8, it will be seen that each compartment 35 is equipped with two movable cutters or knives 48 as well as two fixed counter-cutters 49 (FIG. 8). The fixed counter-cutters or blades 49 are fixed in a recessed manner in a respective radially extending groove 50, which is formed in the surface of the partition wall 34 serving as the counter-jaw for the contact jaws 36. From the showing of FIG. 8 it will be recognized that the cutter edges of the coacting knives or blades 48 and 49 in the direction of the corresponding closer end face of the cell wheel 20 are directly arranged ahead of the contact jaws 36. The movable cutters or blades 48 are each formed at the one longitudinal or lengthwise edge of a rocker or balance 51, which is articulated at one end at the hinge point 39 of the balance 40 of the compartment 35 which is leading, viewed in the direction of rotation. At their other free end the rockers or balances 51 of the cutters 48 are hingedly connected via a counter-coupling 52 with the one end of an angle lever 53, the apex of which is pivotably mounted at location 54 at a bearing eyelet 55. The bearing eyelets 55 are secured at the side or face of the partition wall 34 to the next following compartment 35, which side faces away from the contact jaws 36. At its free end each angle lever 53 carries a follower roll 56 which is held by a not particularly further illustrated spring in continual engagement with a radially inwardly oriented control cam 57 which, in turn, is formed at the inside of the ring 30. The reason that in FIG. 1 there have been illustrated two rings or ring members 30 is that each of the rockers or rocker arms 51 and therefore each of the cutters 48 can be actuated via its own follower roll or roller 56. It will be apparent from the discussion to follow that for the other embodiment there is only required one control cam because in each compartment of the other embodiment there is also only provided one pair of cutters. The control cam 57 is constructed in such a manner that the cutters 48, during the course of a revolution of the cell wheel 20, execute a cutting movement and back again, and in relation to the control cam 46 additionally in such a way that the cutting stroke first then begins when the contact jaws 36 have reached their closed position. The part of the control cam 57 which is visible in sector B of FIG. 2 encompasses both the cutting stroke, which is completed upon reaching the inner apex point 58 of the control cam 57, as well as also the opening stroke which directly follows the apex point 58.

With the here described exemplary embodiments it is contemplated that the movement direction, in which the flat structures are delivered to and away from the cutting or cutter tools (contact jaws and cutters), extends parallel to the axis of rotation 21. Of course it is possible to infeed such flat structures to the compartments 35 also in the radial direction. As to the following discussion reference will firstly be made to FIG. 1, then to FIGS. 2, 4 and 5A as well as 6 and 9.

In FIG. 1 there is shown in phantom lines that there is arranged ahead of the apparatus 10 an infeed wheel 59 which is similar regarding its subdivision and rotational speed to the cell wheel 20. The flat structures —here printed products 60— are delivered with the aid of this infeed wheel 59 radially and copy for copy, for instance in the manner described in the commonly assigned, copending United States application Serial No. 655,562, filed Feb. 5, 1976, and entitled "Apparatus For Processing Products, Especially Printed Products", to which reference may be readily had and the disclosure of which is incorporated herein by reference. From the location of the infeed wheel 59 the printed products are pushed into the compartments 35 of the cell wheel 20 in the direction of the arrow 61 (FIG. 1). As soon as the printed products have reached one of the compartments 35, they arrive at the operative region of a feed drive which functions stepwise in axial direction and which now will be described in detail, in particular based upon the showing of FIGS. 4 and 5A.

Figure 5A:
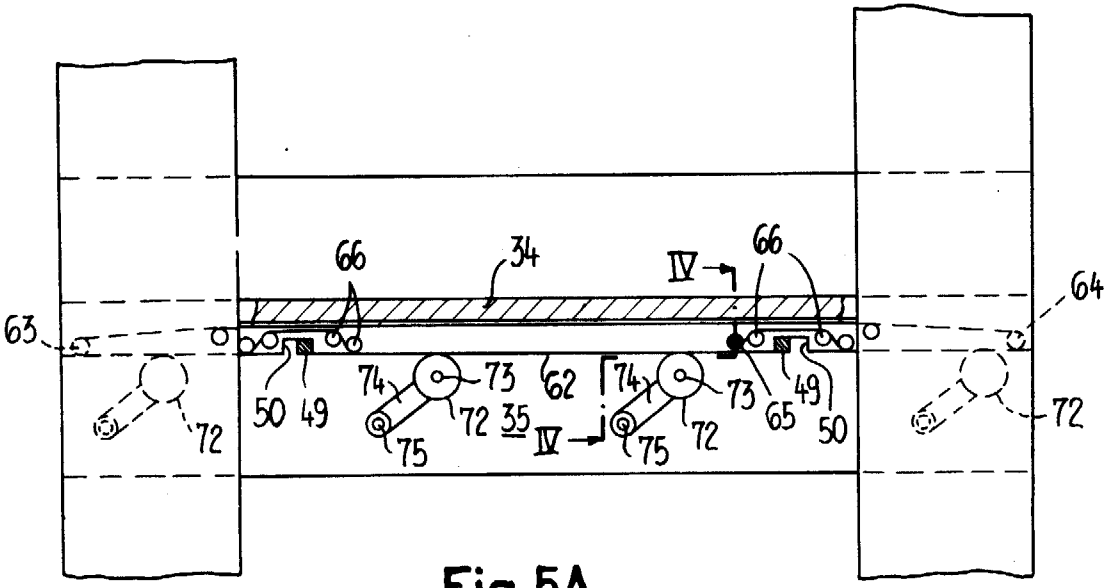
FIGS. 5A and 5B are simplified sectional views taken approximately along the line V—V of FIG. 4.
Figure 5B:
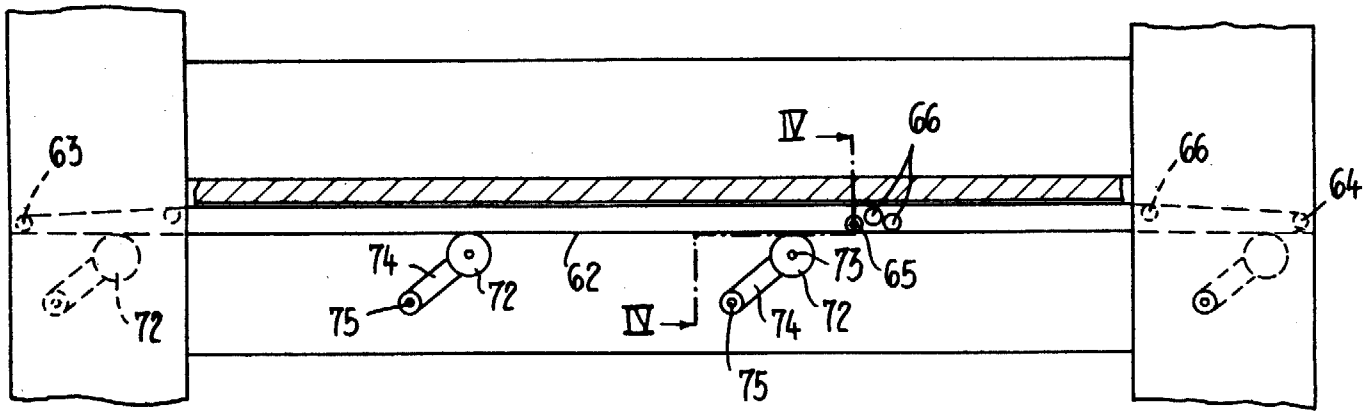

This feed drive encompasses a thin, driven conveyor band or belt 62 which is installed in each of the partition walls 34 and the active conveying run of which protrudes slightly from the side of the partition wall 34 confronting the contact jaws 36. The conveyor band 62 is guided both at its periphery and at its ends about a freely rotatable deflection roller 63, 64, and intermediate thereof about a drive roll or roller 65. Additionally, the conveyor band 62 is guided over further freely rotatable deflection rolls or rollers 66 which serve the purpose of guiding the course of the conveyor band in such a manner that it does not come into conflict with the cutter tools (contact jaws and cutter) provided in the associated compartment 35. In FIG. 5A the conveyor band 62 is guided below the fixed or stationary cutter or blade 49 with the aid of the deflection rolls 66.

Each of the drive rolls 65 (FIG. 4) is seated upon a shaft 69 rotatably mounted in two self-lubricating bearing bushings 67, 68 within the partition walls 34. The shaft 69 extends at right-angles to the axis of rotation 21 of the cell wheel 20 past the end of the relevant partition wall. At its free end each of the shafts 69 is equipped with a friction wheel 70 which coacts with a friction rim 71 formed at the end face of the ring segment 52. The friction wheels 70 and therewith the associated conveyor band 62 are thus only driven for such length of time as the friction wheels 70 engage with the fricton rim 71, i.e., in FIG. 2 in the sector designated by reference character C. This sector C extends essentially over that region of the control cams 46 and 57 where such retain the cutter tools in the compartments 35 in the open position.

Cooperating with each of the conveyor bands 62 is a set of freely rotatable contact rollers 72 which are freely rotatably mounted at the region of the floor of the relevant compartment at a shaft journal 73. The inner end of the shaft journal 73 is attached at a cantilever 74 which, in turn, is pivotably mounted upon a pin 75 radially protruding from the floor of the associated compartment 35. A spring 76 wound about the pin 75 strives to press the cantilever 74 and together therewith the contact roller or roll 72 against the associated conveyor band or belt 62. Thus it will be recognized that the feed or advance drive essentially composed of the conveyor band 62 and the contact rollers 72 not only serves the purpose of effectively advancing the printed products 60 in the lengthwise direction of the compartments 35 (as long as the friction wheels 70 are in engagement with the friction rim 71), but rather also to fixedly clamp the printed products 60 in the relevant compartment 35 as long as the contact jaws 36 are not yet in their closed position or have again reached their open position. By appropriately calculating the start and the end of the friction rim 71 (FIG. 2, sector C) it is thus possible to bring each printed product 60 exactly in the position desired for cutting thereof and to again remove it from such position. Additionally, with one and the same feed drive it is possible to simultaneously withdraw a printed product to the cut out of the infeed wheel 59 (FIG. 1) and to eject a cut printed product out of the cell wheel 20 (attention being directed to the right of FIG. 1).

The feed or advancing drive for the second embodiment (FIGS. 3, 4, 5B and 10) is essentially similarly constructed as that of the first described embodiment, so that no further extensive discussion thereof would appear to be necessary. One difference will be apparent however from the showing of FIG.5B in that the guide of the conveyor band 62 is simpler than that of FIG. 5A. This is so because with this embodiment the conveyor band or belt 62 does not hinder the cutter tool and accordingly need not move aside therefrom.

Equally the cutting tools of this second exemplary embodiment are basically similarly constructed as those of the first exemplary embodiment previously described. The reference characters for the functionally equivalent components are therefore the same, however there has been added thereto a prime marking as previously explained. This is so for the contact jaws 36', for the traverse 38' (FIG. 10), for the rocker or balance 40', for the counter-coupling 41', for the angle lever 42', the bearing eyelet 44', the follower roll 45' and the control cam 46'. The only difference resides in the fact that the main dimension of the contact jaws 36' is parallel to the axis of rotation 21 of the cell wheel 20, whereas the main dimension of the contact jaws 36 in the embodiment of FIG. 2 extends at right-angles to such axis of rotation 21.

Figure 6:
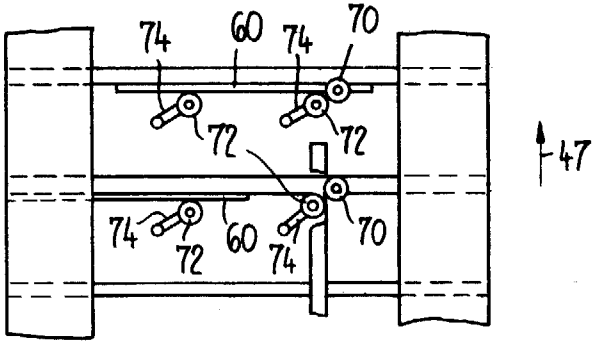

With this embodiment the movable cutter or blade 48' (FIG. 10) is likewise formed at the lengthwise side of a rocker or balance 51'. This rocker 51' is pivotably mounted at one end about a pin 77 radially protruding from the peripheral end of the partition wall 34. The free end of the rocker or rocker arm 51' —just as was the case for the rocker 51— is coupled via the counter-coupling 52' at the angle lever 53' which, in turn, is mounted at the bearing eyelett 55'. The angle lever 53' carries at its other end the follower roller or roll 56' which is held by means of a not further illustrated spring in continuous engagement with the control cam 57'. In contrast to the control cam 57, this control cam 57' is axially oriented, however likewise formed at the inside of the ring 30 appearing at the left of the showing of FIG. 1. The ring 30 at the right of FIG. 1 is therefore not necessary for this embodiment. The mode of operation of the described apparatuses will be readily apparent when referring to the sequence of FIGS. 6, 7, 8 and 9 and FIG. 10. In FIG. 6 there are visible two compartments which move past the friction rim 71 in the direction of the arrow 47. In the case of the lower compartment the friction roll 70 is still in engagement with the friction rim 71, i.e., the feed or advance drive is still effective, the corresponding printed product 60 is still in the process of being brought into a position suitable for cutting, whereas in the upper compartment the friction wheel 70 has already departed from the friction rim 71, because the feed drive has brought the printed product 60 into the desired position. In the lower compartment of FIG. 7 there will be recognized the printed product 60 which is about to be fixedly held by the contact jaws 36. In the upper compartment of FIG. 7 the printed product 60 is fixedly clamped by the contact jaws 36. In the lowermost compartment of FIG. 8 there is again repeated in principle the situation of the upper compartment of FIG. 7. Both of the movable cutters 48 at the rockers or balances 51 are in the process of approaching the product 60, in the central compartment of FIG. 8 the movable cutters 48 have already cut-off part of the printed product which protrudes past the contact jaws 36, in the uppermost compartment of FIG. 8 both the contact jaws and the cutter are in their open position, so that the printed product, as illustrated in the upper compartment of FIG. 9, can be ejected towards the right out of the cell wheel 20 by means of the feed drive.

Figure 10:
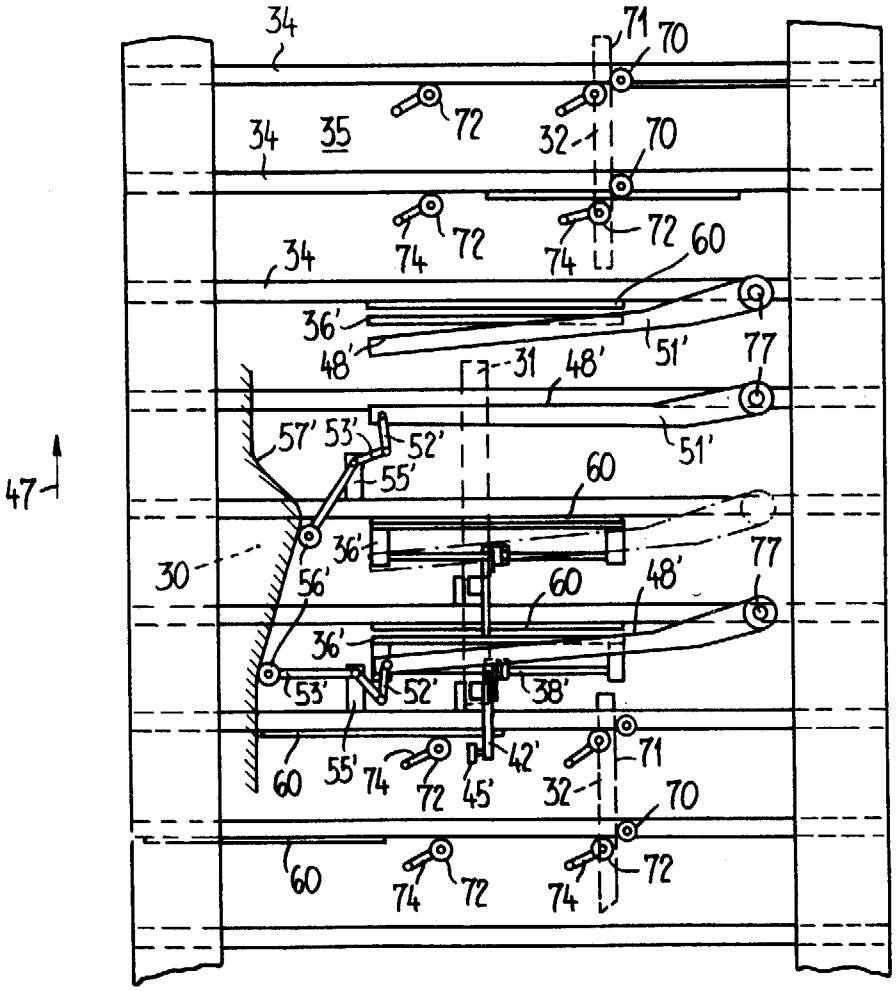
FIG. 10 likewise is a simplified illustration looking in radial direction, not necessarily at direct neighboring compartments of the apparatus according to FIG. 3 for the purpose of explaining its mode of operation.

In the lower two compartments of FIG. 10 a printed product 60 is in the process of being brought by the feed device into the desired position which it has in the third compartment from the bottom of FIG. 10. In the fourth compartment from the bottom of FIG. 10 the contact jaw 36' has fixedly clamped the product, in the next following compartment the cutter 48' has cut away the part of the printed product 60 protruding past the contact jaw 36', and in the sixth compartment from the bottom both the contact jaw 36' as well as the cutter 48' are in the open position. Thus, the feed drive can become again effective (uppermost two compartments of FIG. 10).

Figure 3:
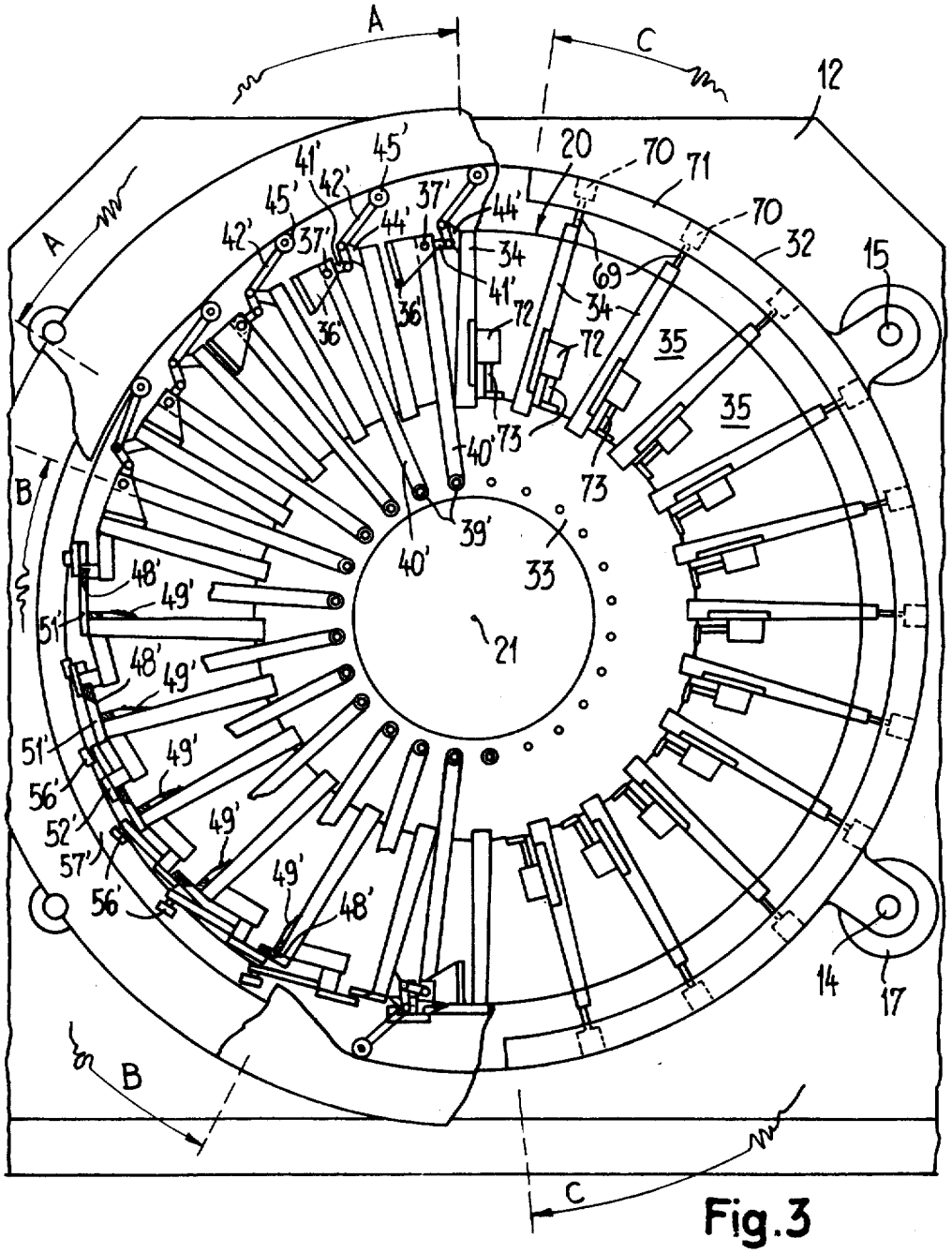
FIG. 3 is a cross-sectional view through the other exemplary embodiment, illustrated similar to the showing of FIG. 2.
Figure 4:
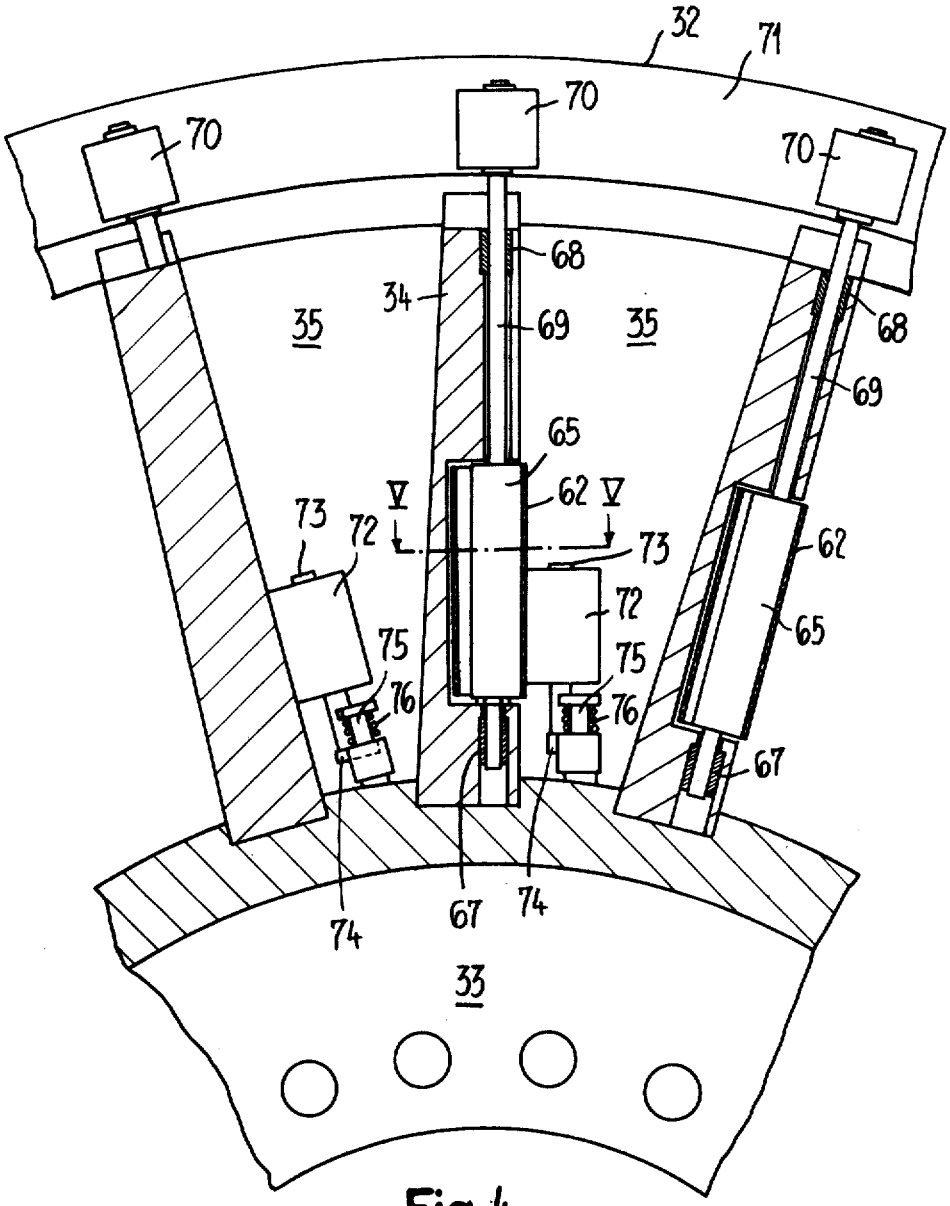
FIG. 4 illustrates on an enlaged scale and in sectional view an embodiment of the feed means associated with the cutter tools (not illustrated in this Figure), taken approximately along the line IV—IV of FIG. 5A or FIG. 5B.

If it is desired to cut a flat structure at three sides then it is only necessary to mount together in principle a unit according to FIG. 2 and a unit according to FIG. 3. This is readily possible since for such a device consisting of two units to be devised it is possible to use one and the same feed drives.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. An apparatus for cutting continuously arriving flat structures, especially printed products, comprising a revolving driven rim of essentially similar cutter tools provided with traveling follower elements, a common control cam for actuating the cutter tools via the traveling follower elements, individual feed means provided for each of the cutter tools for the infeed and withdrawal of a flat structure.

2. The apparatus as defined in claim 1, further including a cell wheel having a plurality of compartments, each cutter tool being arranged in a compartment of the cell wheel.

3. The apparatus as defined in claim 1, wherein each cutter tool comprises at least one to-and-fro pivotal cutter and a stationary counter-cutter associated with the to-and-fro pivotal cutter.

4. An apparatus for cutting continuously arriving flat structures, especially printed products, comprising a revolving driven rim of essentially similar cutter tools provided with traveling follower elements, a common control cam for actuating the cutter tools via the traveling follower elements, feed means provided for each of the cutter tools for the infeed and withdrawal of a flat structure, a cell wheel having a plurality of compartments, each cutter tool being arranged in one of the compartments, each of the compartments beng bounded by a pair of walls, the counter-cutter being mounted in a recessed fashion in one said wall of the associated compartment of the cell wheel.

5. An apparatus for cutting continuously arriving flat structures, especially printed products, comprising a revolving driven rim of essentially similar cutter tools provided with traveling follower elements, a common control cam for actuating the cutter tools via the traveling follower elements, feed means provided for each of the cutter tools for the infeed and withdrawal of a flat structure, and each cutter tool comprises at least one pair of coacting cutters and a pair of contact jaws associated with such pair of cutters.

6. The apparatus as defined in claim 5, further including a cell wheel having a plurality of compartments, each cutter tool being arranged in a compartment of the cell wheel, each compartment being bounded by walls, one cutter and a counter-jaw being fixedly mounted in a wall of a compartment of the cell wheel.

7. An apparatus for cutting continuously arriving flat structures, especially printed products, comprising a revolving driven rim of essentially similar cutter tools provided with traveling follower elements, a common control cam for actuating the cutter tools via the traveling follower elements, feed means provided for each of the cutter tools for the infeed and withdrawal of a flat structure, each cutter tool comprises at least one to-and-fro pivotal cutter and a stationary counter-cutter associated with the to-and-fro pivotal cutter, hinge drive means for connecting the pivotal cutter with a follower roll, a closed control cam upon which travels the follower roll, each said follower roll defining said follower elements.

8. The apparatus as defined in claim 6, wherein the other cutter is coupled via a hinge drive means at a follower roll which travels upon a closed control cam, each said follower roll defining said follower elements.

9. The apparatus as defined in claim 7, wherein the control cam encloses the path of movement of the cutter tools.

10. The apparatus as defined in claim 8, wherein the control cam encloses the path of movement of the cutter tools.

11. The apparatus as defined in claim 6, further including hinge drive means for coupling the other contact jaw at a follower roll defining one said follower element and which travels upon a closed control cam.

12. The apparatus as defined in claim 11, wherein the control cam actuating the contact jaws encloses the revolving path of travel thereof.

13. The apparatus as defined in claim 1, wherein the feed means infeeds and withdraws the flat structure in a direction substantially parallel to the axis of rotation of the cutter tools.

14. The apparatus as defined in claim 12, further including a cell wheel having a plurality of compartments, each cutter tool being arranged in a compartment of the cell wheel, each compartment being bounded by side walls, a stepwise drivable conveyor band arranged in each compartment of the cell wheel and serving as the feed means, the conveyor band having an active conveying run which is practically in alignment with one of the side walls of the associated compartment.

15. The apparatus as defined in claim 14, wherein the active conveying run of the conveyor band has associated therewith a set of freely rotatable rollers which are resiliently pre-biased in the direction of the active conveying run of the conveyor band, the freely rotatable rollers serving to press the flat structure which is to be advanced against such run.

16. An apparatus for cutting continuously arriving flat structures, especially printed products, comprising a revolving driven rim of essentially similar cutter tools provided with traveling follower elements, a common control cam for actuating the cutter tools via the traveling follower elements, feed means provided for each of the cutter tools for the infeed and withdrawal of a flat structure, a cell wheel having a plurality of compartments, each cutter tool being arranged in a compartment of the cell wheel, the cell wheel has an essentially horizontally extending lengthwise axis, at least three pairs of rollers engaging with the circumference of the cell wheel for rotatably mounting said cell wheel, one roll of each pair engaging at the region of the one axial end of the cell wheel and the other roll engaging at the region of the other axial end of the cell wheel.

17. The apparatus as defined in claim 16, further including a respective common shaft upon which there are arranged the rollers of each pair, and means for driving at least one of these shafts.

18. The apparatus as defined in claim 17, further including control cams for actuating cutting tools and contact jaws, the shafts of the roller pairs extending through said control cams and the control jaws and being rotatably mounted therein, and means for securing the control cams against rotation.

19. The apparatus as defined in claim 14, further including a drive drum about which there is guided the conveyor band of each compartment, a friction wheel with which there is coupled the drive drum, said friction wheel cooperating with a stationarily arranged friction segment common to all conveyor bands.

20. The apparatus as defined in claim 19, wherein the friction segment encloses the revolving path of travel of the compartments.

21. The apparatus as defined in claim 20, further including a control cam for actuating the contact jaws, means for securing the control cams for both said cutting tools and said contact jaws against rotation and at least a part of the shafts of the roller pairs extending through the friction segment and being rotatably mounted therein, and means for securing the friction segment against rotation.

22. The apparatus as defined in claim 1, wherein the cutter tools have cutter edges arranged parallel to the axis of their rotational movement.

23. The apparatus as defined in claim 1, wherein the cutter tools have cutter edges which are arranged essentially at right-angles to the axis of their rotational movement.

24. The apparatus as defined in claim 1, wherein the control cam for actuating the cutter tools is oriented towards the axis of the rotational movement of such cutter tools.

25. The apparatus as defined in claim 1, wherein the control cam for actuating the cutter tools is directed radially inwardly with respect to the axis of the rotational path of travel of the cutter tools.

26. An apparatus for cutting a substantially flat structure, comprising a revolving driven rim of pairs of cooperating cutter blades, means including a common control cam for actuating one of the cutter blades of said pairs, and individual feed means provided for and corevolving with said pairs of cutter blades for the infeed and withdrawal of a flat structure.

* * * * *